United States Patent [19]

Nicholl et al.

[11] Patent Number: 4,473,121

[45] Date of Patent: Sep. 25, 1984

[54] PRESSURE REGULATING AND RELIEF VALVE ASSEMBLY

[75] Inventors: William J. Nicholl, Caraopolis; James R. Shychick, Aliquippa, both of Pa.; John H. Leggett, Pineville, La.

[73] Assignee: The Union Corporation, Verona, Pa.

[21] Appl. No.: 404,597

[22] Filed: Aug. 2, 1982

[51] Int. Cl.[3] ..... E21B 43/12; E21B 43/24

[52] U.S. Cl. ..... 166/325; 166/302; 166/59; 137/115

[58] Field of Search ..... 166/57, 59, 302, 321, 166/325; 137/115, 512, 550; 219/277, 278

[56] References Cited

U.S. PATENT DOCUMENTS

| | | | |
|---|---|---|---|
| 2,245,210 | 6/1941 | McElwaine | 166/57 |
| 3,140,722 | 7/1964 | Gordon | 137/108 |
| 3,307,569 | 3/1967 | Erikson | 137/116 |
| 3,352,359 | 11/1967 | Sutliff et al. | 166/53 |
| 3,717,203 | 2/1973 | Kirkpatrick et al. | 166/224 |
| 3,763,879 | 10/1973 | Jaworek | 137/550 |
| 3,968,839 | 7/1976 | Swihart, Sr. | 166/250 |
| 3,993,129 | 11/1976 | Watkins | 166/319 |
| 4,082,147 | 4/1978 | Wolff et al. | 166/314 |
| 4,127,169 | 11/1978 | Tubin et al. | 166/314 |
| 4,171,708 | 10/1979 | Pareja | 137/115 |
| 4,185,691 | 1/1980 | Tubin et al. | 166/314 |
| 4,327,805 | 5/1982 | Poston | 166/272 |
| 4,336,839 | 6/1982 | Wagner et al. | 166/59 |
| 4,387,736 | 6/1983 | Major | 137/550 |

*Primary Examiner*—Stephen J. Novosad
*Assistant Examiner*—William P. Neuder
*Attorney, Agent, or Firm*—Fleit, Jacobson, Cohn & Price

[57] ABSTRACT

A pressure regulating and relief valve assembly, such as an assembly positionable in a lower portion of a well casing. The valve assembly has a main relief valve assembly or back pressure regulator that is designed to open when the steam pressure exceeds a first predetermined value. A secondary relief valve assembly is provided to vent excess pressure to a space exterior of the valve assembly when the pressure exceeds a second predetermined value, the second value being higher than the first value. The valve assembly is positionable within a well casing at the bottom of a bore hole between a steam generator and a probe utilizing the steam generator. When the assembly is so positioned, excess pressure is vented to a space between the valve assembly and the inner surface of the encompassing well casing.

7 Claims, 8 Drawing Figures

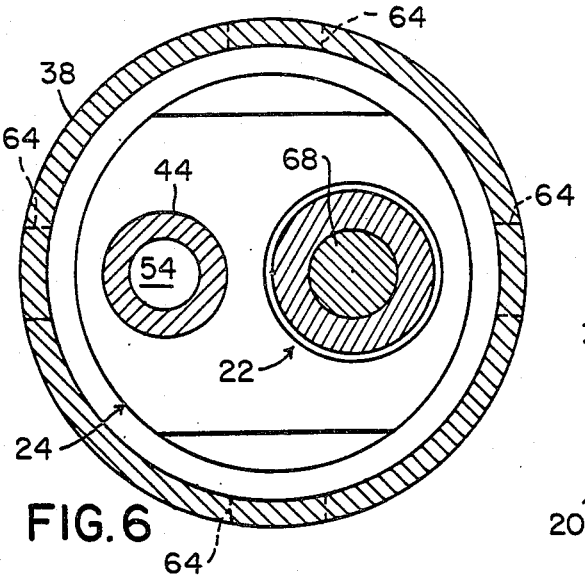
FIG. 6
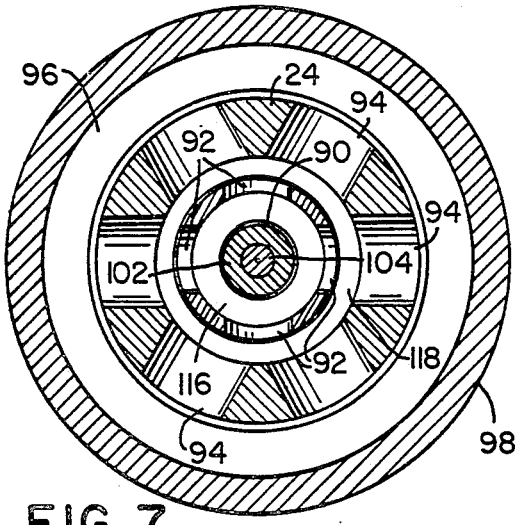
FIG. 7
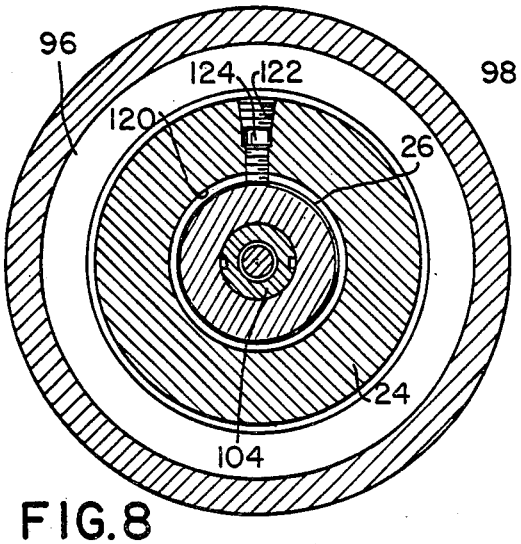
FIG. 8
FIG. 3
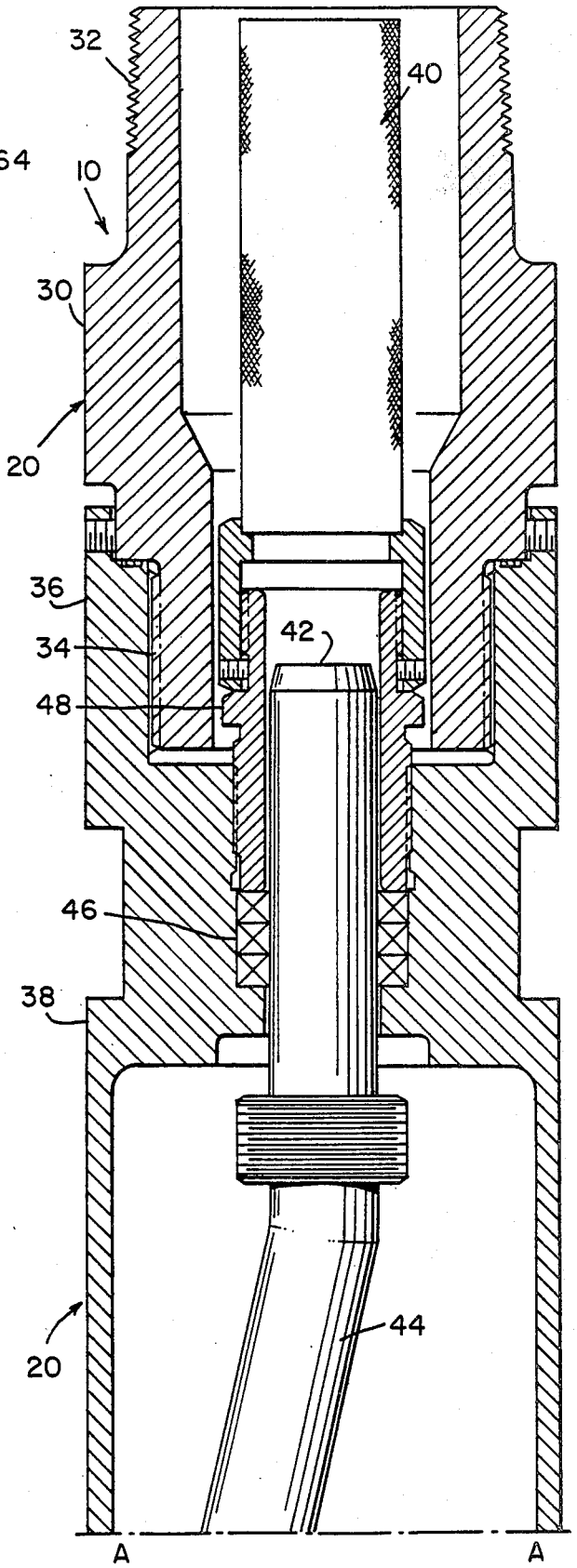

PRESSURE REGULATING AND RELIEF VALVE ASSEMBLY

BACKGROUND OF THE INVENTION

1. Field of the Invention

The present invention relates to a pressure regulating and relief valve assembly. More particularly, the invention relates to such valve assembly positioned in a well casing between a steam pressure generator and a probe using the steam pressure.

2. Description of the Prior Art

It is known that additional oil can be recovered from producing oil fields by injecting pressurized steam into the fields. The steam liquidizes oil within the fields and forces it to positions where it can be recovered. Conventional systems for pressurizing oil fields have utilized steam generators positioned above ground because controls for the generators were too large to fit inside of well casings.

SUMMARY OF THE INVENTION

The present invention provides a combination back pressure regulator and safety relief valve assembly designed to provide pressure control and over pressure protection for a steam generator working in a deep hole, such as an oil well. The valve assembly has an external diameter smaller than the internal diameter of the well casing so that pressure control can take place close to a steam generator positioned anywhere within a well casing, for instance close to the bottom of the bore hole.

The valve assembly provided by the present invention is intended to replace existing controls, which, because of their size, must be located above ground, outside of the well casing. The valve assembly is compact and incorporates two valves in one, thus eliminating extensive interconnecting piping. The valve assembly is designed to be self-contained and, once set, to require no further adjustment.

One embodiment of the valve assembly provided by the present invention is designed to be positioned between a steam generator and a probe utilizing the generated steam. An inlet section of the assembly has a portion thereof connectable to the steam generator and an outlet section with a portion thereof connectable to the probe. A body assembly is positioned between the inlet and outlet sections and has a plurality of interconnected fluid passages formed in its interior. A first of the passages of the body assembly has an inlet in fluid communication with the inlet section. A second of the passages provides fluid communication between the outlet of the first passage and the outlet section of the valve assembly. A first valve is provided for controlling fluid flow out of the second passage and is urged into a position blocking fluid flow until the generated steam pressure exceeds a first predetermined value. Once the first value has been exceeded, the first valve opens to permit fluid flow through the valve assembly. The body assembly also includes a third passage in fluid communication with the first passage. The casing of the valve assembly has at least one opening or passage formed therein so that fluid flowing out of the third passage can flow out of the valve assembly, for instance, into the encompassing well casing. A second valve is provided for controlling fluid flow through the third passage. The second valve prevents fluid flow until the pressure of the generated steam exceeds a second predetermined value, which is higher than the first predetermined value.

Thus, the third passage and the second valve provide a pressure control and relief mechanism.

The invention, and its objects and advantages, will become more apparent in the detailed description of the preferred embodiments hereinafter presented.

BRIEF DESCRIPTION OF THE DRAWINGS

In the detailed description of the preferred embodiments of the invention hereinafter presented, reference is made to the accompanying drawings, in which:

FIG. 3 is a schematic, enlarged view taken above the line A—A of FIG. 2, slightly modified;

FIG. 6 is a view along line 6—6 of FIG. 4;

FIG. 7 is a view along line 7—7 of FIG. 5; and

FIG. 8 is a view along line 8—8 of FIG. 5.

DESCRIPTION OF THE PREFERRED EMBODIMENTS

The following description will be directed in particular to elements forming part, or cooperating more directly with, the present invention. Elements not specifically shown or described herein are understood to be selectable from those known in the art.

Figure 1:
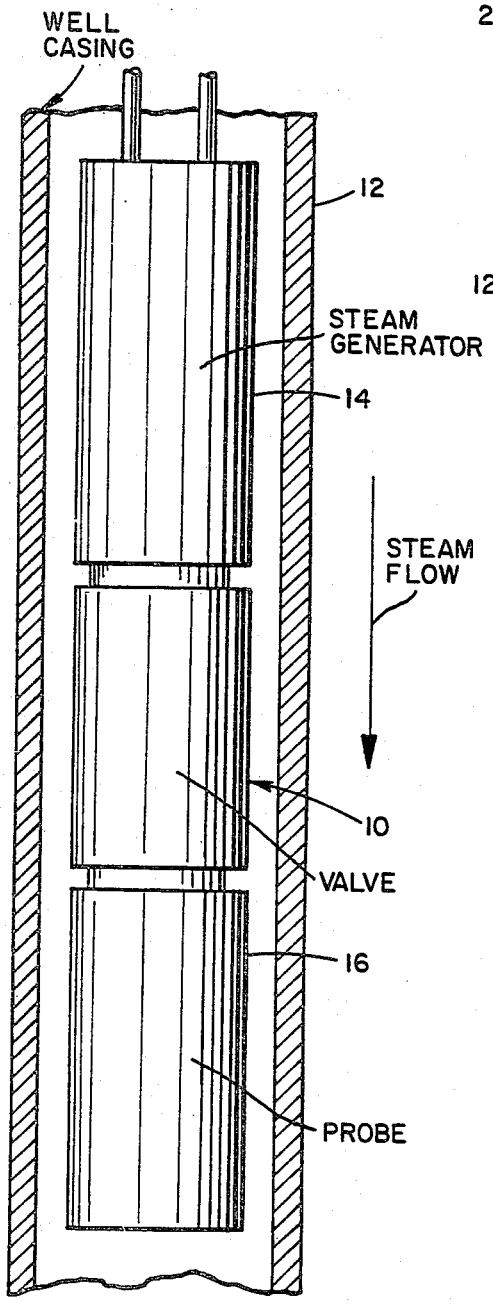
FIG. 1 is a schematic representation of a valve assembly according to the present invention positioned within a well casing.

Referring now to the drawings, and to FIG. 1 in particular, one embodiment of a downhole pressure regulating and relief valve assembly according to the present invention, generally designated 10, is illustrated in a position ready for use. The valve assembly 10 is illustrated within a well casing 12, preferably in a lower portion of the well casing. It should be appreciated, however, that the valve assembly 10 also is usable with an above the ground installation requiring pressure relief and pressure control, as provided by the valve assembly 10. An inlet of the valve assembly 10 is connected to means for generating pressure, such as a steam generator 14. Such steam generator could be any type of steam generator reduced in size so as to fit within the well casing. An outlet of the valve assembly 10 is connected to means for using the generated pressure, such as a nozzle or probe 16. The probe 16 has one or more orifices for directing the discharge of steam received from the valve assembly 10. The external dimensions of the valve assembly 10, the steam generator 14, and the probe 16 are less than the interior dimensions of the well casing 12 so that all of these members can be moved through the interior of the casing and positioned close to the bottom thereof. In this manner, the steam generator is positioned close to the location where the steam is to be utilized.

Figure 2:
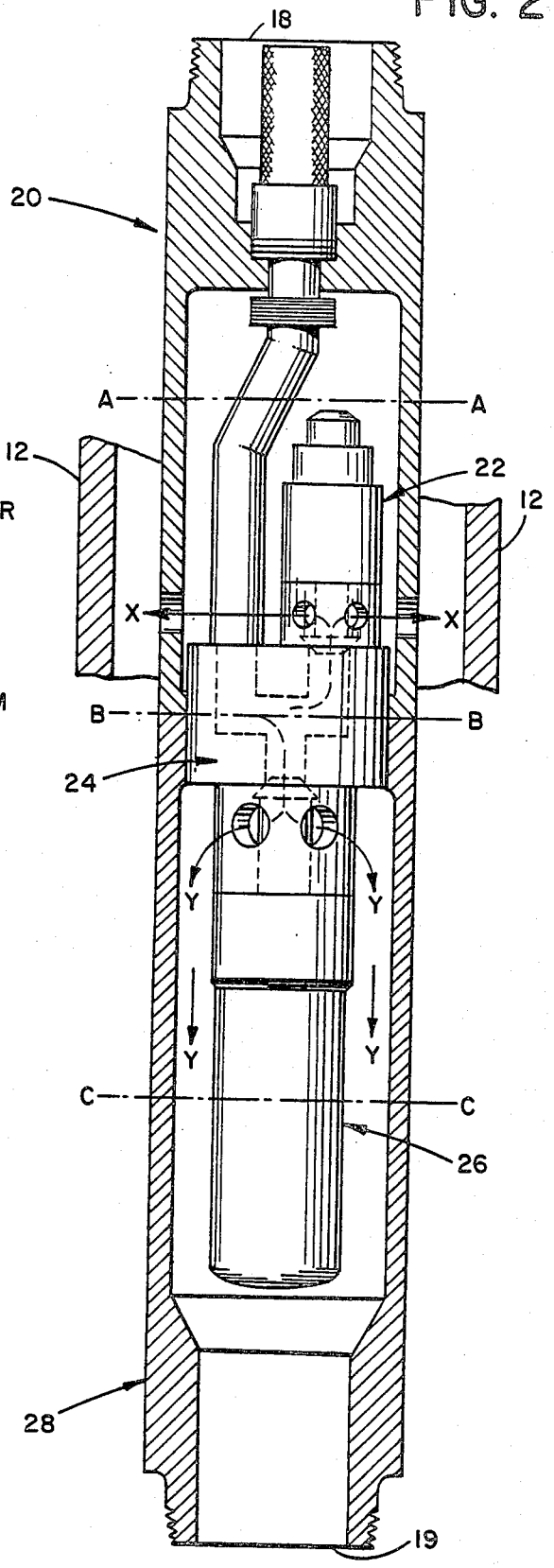
FIG. 2 is a schematic view, partially in section, of one embodiment of a downhole pressure hole regulating and relief valve assembly of the type illustrated in FIG. 1.

Referring now to FIG. 2, one embodiment of the valve assembly 10 is schematically illustrated. The valve assembly 10 has an inlet 18 connectable to the steam generator 14 and an outlet 19 connectable to the probe 16. The valve assembly 10 includes an inlet section assembly 20, a secondary relief valve assembly 22 (second valve means), a body assembly 24, a main relief valve assembly 26 (first valve means), and an outlet section assembly 28. The secondary relief valve assembly 22 controls fluid flow from the interior of the body assembly 24 into a space between the exterior of the valve assembly 10 and inner walls of the well casing 12 encompassing the valve assembly 10, as schematically illustrated by the arrows "X". The main relief valve assembly 26 controls fluid flow from the inlet section assembly 20, through the body assembly 24, and the outlet section 28, as schematically illustrated by the arrows "Y".

Referring now to FIG. 3, components of the inlet section assembly 20 are illustrated. The inlet section 20 preferably is provided with an inlet adaptor 30 that has an externally threaded end section 32 connectable to the steam generator 14. It should be readily apparent that the configuration of the end section 32 is determined by the configuration of the outlet of the steam generator. The adaptor 30 has a threaded or grooved inner end 34 that is shaped to mate with a complimentary shaped end portion 36 of inlet casing 38. A set screw releasably secures the adaptor to the casing. Alternatively, as illustrated in FIG. 2, the adaptor is formed integral with the casing. A strainer assembly 40 is located within a bore formed in the adaptor 30 for filtering fluids entering the valve assembly 10. An inlet end 42 of a pipe 44 is received within a bore formed within the casing 38 and/or the adaptor 30. Packing 46 surrounds the end 42 to provide a substantially fluid-tight seal. A packing nut 48 holds the packing 46 in position. The use of packing 46 and packing nut 48 allows the pipe 44 to "free float" within the casing 38. This allows for thermal expansion, dynamic force deflection, and a pressure elongation. Mounting of the pipe 44 in such manner results in the transmission of axial tension loads through the outer casing 38, not through the inner components of the valve assembly. Such loads can be at least as high as 80,000 p.s.i.

Figure 4:
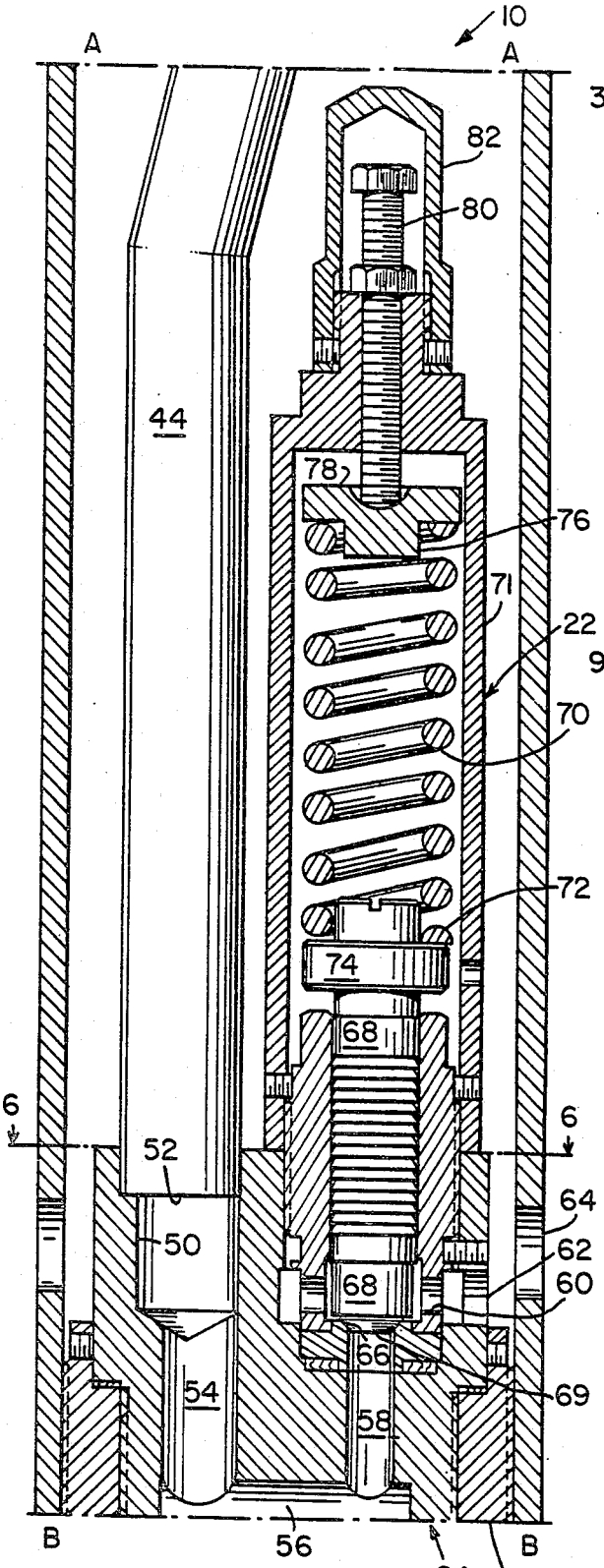
FIG. 4 is a schematic, enlarged view taken between the lines A—A and B—B of FIG. 2, partially in section.

Referring now to FIG. 4, a portion of the body assembly 24 is illustrated. The body assembly 24 has an inlet bore formed therein for receiving an end 52 of the pipe 44. A first passage 54 has an inlet in fluid communication with the pipe 44 and an outlet in fluid communication with a central chamber or passage 56. A series of interconnected bores or passages 58, 60, 62, and 64 form a passageway or passage between the chamber 56 and the exterior of the inlet casing 38. Such passageway allows venting of excess pressure from the interior to the exterior of the valve assembly 10, for example, venting into a space between the exterior of the valve casing and the interior walls of the well casing 12 encompassing the valve assembly 10. A seat ring 66 is positioned between the passage 58 and the passage 60. A valve plug 68, which is part of the secondary relief valve assembly 22, has an end portion 69 thereof engageable with the seat ring to block fluid flow out of the bore 58. A spring 70 disposed within a casing 71 has an end 72 exerting a biasing force on an end portion 74 of the valve plug 68 so that end portion 69 is urged or biassed into a position blocking fluid flow through the passage 58. The other end 76 of the spring 70 contacts a washer 78 that is part of a tension adjusting mechanism 80. Appropriate adjustment of the mechanism 80 varies the force that must be overcome before the valve plug 68 is moved to allow fluid flow through the bore 58. Preferably, a protective cap 82 surrounds the tension adjusting mechanism 80.

Figure 5:
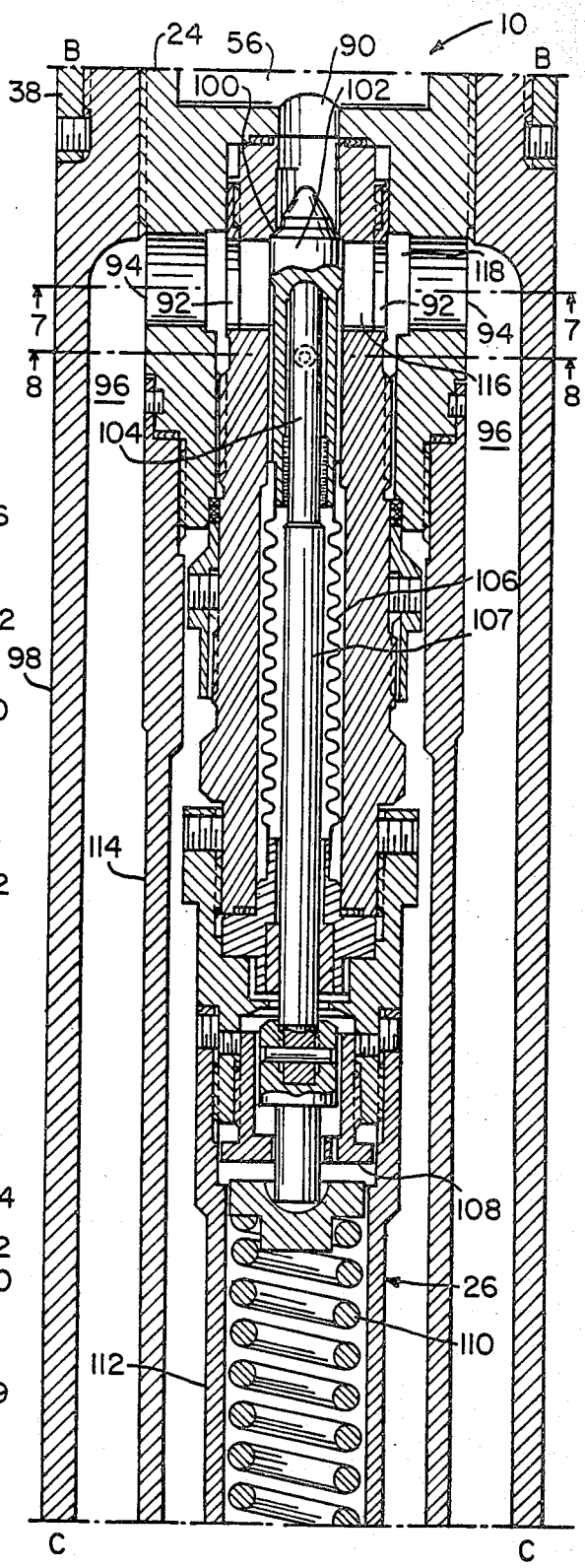
FIG. 5 is a schematic, enlarged view taken between the lines B—B and C—C of FIG. 2, partially in section.

Referring now to FIG. 5, another portion of the body assembly 24, together with a portion of the main relief valve assembly 26, is illustrated.

The body assembly 24 has a series of passages or bores 90, 92, and 94 that establish fluid communication between the central chamber 56 and a space 96 formed within the outlet casing 98. The outlet end of the bore 90 provides a first outlet for the body assembly 24. A seat ring 100 is positioned between the passages 90 and 92. An end portion 102 of a stem assembly or valve member 104 is engageable with the seat ring 100 to prevent fluid flow through the passage 90. A bellows assembly 106 is incorporated into an intermediate portion of the valve member 104 to prevent flow of pressurized steam around a shaft 107 of the valve member 104. The bellows assembly thereby protects inner components of the valve member 104, which is the regulating valve of the valve assembly, from contamination by the steam and enhances the service life of the regulating components of the assembly. While a bellows assembly is usable with the relief valve assembly 22, it is not essential because the assembly 22 is a safety valve. A portion 108 of the valve member forms a stop member for limiting the amount of axial movement of the valve member. The stop member 108 thereby limits the size of the interconnection between the passages 90 and 92. A spring 110 exerts a biasing force on the valve member 104 that urges the end portion 102 into engagement with the seat ring 100. A casing 112 encompasses the spring 110 and forms a spring chamber. Preferably, a tension adjusting mechanism similar to the mechanism 80 is provided for adjusting the biasing force exerted on the valve 104 by the spring 110. A seal pipe 114 surrounds and protects the inner portions of the main relief valve assembly 26. Also, the seal pipe cooperates with the outlet casing 98 to define the flow passage or space 96 between the passage 94 and the outlet 19 of the valve assembly.

Referring now to FIGS. 6 to 8, the flow passages of the valve assembly 10 are illustrated. First, as illustrated in FIG. 6, the body assembly 24 has a tapped portion that holds the outlet end of pipe 44. The body assembly 24 has another portion thereof shaped to receive and support components of the relief valve assembly 22, such as valve plug 68.

FIG. 7 illustrates the series of passageways establishing fluid communication between the bore 90 (not illustrated in FIG. 7) and the passage 96. The figure illustrates a separate stem 104 and end portion 102. It should be appreciated that the members can be part of an integral unit. The bore 90 communicates with an annular passage or chamber 116. A plurality of bores 92 communicate the chamber 116 with a second annular chamber 118. The chamber 118 communicates with the space 96 through a plurality of passages 94. It should be readily apparent that such arrangement provides minimum resistance to fluid flow.

As to FIG. 8, the figure illustrates the adjustable connection between the main relief valve assembly 26 and the body assembly 24. The body assembly 24 has a stepped bore 120 formed therein for receiving an end of the main relief valve assembly 26. A threaded bore 122 extends transversely to the bore 120 and receives a set screw 124. Preferably, the outer end of the bore 122 is closed by a second set screw, not shown. The set screw 124 locks the guide bushing 125 of the main relief valve assembly and keeps it from turning. The valve member 104 moves within the bushing 125.

Considering now the operation of the valve assembly 10, pressurized steam enters the inlet 18, passes through the strainer or filter assembly 40 and enters the pipe 44. The steam flows from the pipe 44 through a first passage 54 into the central chamber 56. The steam pressurizes the areas in the central chamber 56, the second passage 90, and the third passage 58. As long as the pressure remains below a first predetermined value, the valve member 104 of the first valve means prevents fluid flow through the second passage 90, and the valve plug 68 of the second valve means prevents fluid flow through the third passage 58. When the pressure in the chamber exceeds a first predetermined value, for instance, between 500 and 1,000 p.s.i.g., the end portion 102 of the valve member 104 gradually moves away from the seat ring 100. This allows steam to pass through the passage 90 into the space 116, through the radial passages or bores 92 into the annular chamber 118. The pressurized steam passes from the chamber 118 through the radial passages 94 into the space 96. This steam then exits the valve assembly 10 through the outlet 19 into the probe 16.

The end portion 102 cooperates with the seat ring 100 and with the stop 108 to determine the maximum allowable steam flow. For instance, one embodiment of the first valve means is designed to open at a pressure between 750 and 1,000 p.s.i.g. and to have a maximum steam flow at approximately 1,500 p.s.i.g.

It should be appreciated that the preceding values are intended for illustrative purposes only. The end portion 102 of the valve member 104 is sized for specific steam flow conditions and preferably is designed as a removable plug cartridge to facilitate interchange when different flow control is needed for other steam flow conditions.

If for some reason the pressure within the chamber 56 exceeds a second predetermined value, for instance approximately 1,800 to 1,900 p.s.i.g., the valve plug 68 is designed to "pop" and exhaust excess pressure through passages 58, 60, 62, and 64. Thus, the passage 58 provides a second outlet for the body assembly 24. Preferably, the valve plug is designed to again block fluid communication at a lower value, such as a value between 1,600 and 1,800 p.s.i.g.

Considering the preceding representative embodiment in more detail, the first valve means or back pressure regulator 26 is designed to open between 750 and 1,000 p.s.i.g. An increase in inlet pressure of 250 p.s.i.g. will yield a capacity of 30 g.p.m. of water. With an inlet pressure of 1500 p.s.i.g., the valve will have a capacity of 14,800 pounds per hour of saturated steam. This will allow the valve to pass any quality of steam ranging from 0% (saturated water) to 100% (saturated steam) by varying the inlet pressure. With this embodiment, the relief valve or second valve means 22 is set to open at 1,900 p.s.i.g. The valve will pass 14,800 pounds per hour of steam with maximum accumulation of 95 p.s.i. The relief valve will pass 30 g.p.m. of water with a maximum accumulation of 850 p.s.i.

From the preceding, it can be seen that the valve assembly 10 is designed to fluidically interconnect the steam generator 14 and the probe 16 in such manner that only steam pressures within a given range are furnished the probe. When steam pressures are below the given range, no steam is furnished the probe 16. When steam pressures exceed the given range, such excessive steam pressures are vented to the outside of the valve assembly, for instance in to the space between the valve assembly and the well casing surrounding the valve assembly so that only a pressure within the range is furnished the probe 16.

Previously, a specific embodiment of the present invention has been described. It should be appreciated, however, that such embodiment has been described for the purposes of illustration only, without any intention of limiting the scope of the present invention. For instance, one or more O-rings can be placed on the shaft 107 in place of or in addition to the bellows assembly 106. Further, the outlet section assembly 28 can include an outlet adaptor similar to the inlet adaptor 30. Use of such adaptors facilitates modification of the valve assembly 10 for use with different components.

In another or further modification, a second pipe, instead of the passage 96, is used to connect the outlet of one of the passages 94 with the outlet section assembly 28. There is no need for a plurality of passages 92 and 94, as illustrated in FIG. 7. The second pipe extends between the outlet of passage 94 and the outlet section assembly 28. Preferably, to provide room for the second pipe, the operative components of the first valve means are off-set from the axis of the valve assembly 10. In addition, components of the valve assembly 10 used to protect the first valve means, such as the seal pipe 114, are not required with this embodiment. With this embodiment, the first valve means is designed to control fluid flow between the body assembly and the second pipe. Further, when a second pipe is used, the end of the second pipe associated with the outlet section assembly can be supported by packing and a packing nut similar to that used to support the end portion 42 of the pipe 44. As a result, the body assembly 24 is spaced from the interior walls of the casing so that the pipes, valve assemblies, and body assembly "free float" within the inlet and outlet casings. In a further modification of this embodiment, the inlet and outlet casings form an integral unit.

From the preceding, it should be appreciated that it is the intention that the present invention be limited only by the appended claims.

What is claimed is:

1. A pressure regulating and relief valve assembly positionable within a well casing for regulating pressure and for relieving excess pressure, said valve assembly being positionable between means for generating pressure and means for using the generated pressure, said valve assembly comprising:

an inlet section having a portion thereof connectable to means for generating pressure;

an outlet section having a portion thereof connectable to means for using the generated pressure;

a body assembly interconnected between said inlet and said outlet sections, said body assembly having a plurality of fluid passages formed therein;

first valve means for controlling fluid flow through said body assembly so that fluid communication is established between said inlet section and said outlet section when the generated pressure exceeds a first predetermined value and is blocked until the generated pressure exceeds the first predetermined value, said first valve means comprising a valve member and biassing means for normally urging said valve member into a position blocking fluid communication through said body assembly; and second valve means for controlling fluid communication between the interior of said body assembly and a space exterior of said body assembly so that fluid communication is established when the generated pressure exceeds a second predetermined value higher than said first predetermined value to thereby relieve excess pressure, said second valve means blocking fluid communication until said second predetermined value is exceeded.

2. A pressure regulating and relief valve assembly positionable in a well casing between means for generating stream pressure and means for using the generated steam pressure, said valve assembly comprising:

(a) an inlet section assembly having:

(1) an inlet casing with an exterior diameter less than the interior diameter of well casing encompassing the valve assembly;

(2) an inlet adaptor having one end portion releasably secured to said inlet casing and another end portion connectable to the means for generating steam pressure;

(3) a bore defined in at least one of said inlet adaptor and said inlet casing for receiving an inlet end of a pipe; and (4) a pipe having an inlet end received in said bore;

(b) a body assembly having;

(1) first passage means having an inlet in fluid communication with said pipe and an outlet;

(2) second passage means having an inlet in fluid communication with the outlet of said first passage means and an outlet;

(3) third passage means having an inlet in fluid communication with the outlet of said first passage means and an outlet;

(4) means for receiving and for holding first valve means in a position controlling fluid flow through the outlet of said second passage means; and (5) means for receiving and for holding second valve means in a position controlling fluid flow through the outlet of said third passage means;

(c) an outlet section assembly having an outlet casing with an exterior diameter less than the interior diameter of the encompassing wall casing, said inlet and said outlet casings having confronting end portions connected to each other and said body assembly being connected to at least one of said inlet and said outlet casings, said outlet casing having a portion thereof connectable to the means for using the generated steam pressure;

(d) first valve means connected to said body assembly and having:

(1) valve member means positioned for controlling fluid flow through said second passage means; and (2) first biassing means for urging said valve member means into position blocking fluid flow through said second passage means, said first biassing means permitting fluid flow through the second passage means when the generated steam pressure exceeds a first predetermined value; and (e) second valve means connected to said body assembly and having:

(1) valve plug means positioned to control fluid flow through the third passage means; and (2) second biassing means for urging the valve plug means into a position blocking fluid flow through the third passage means, said second biassing means permitting fluid flow through the third passage means when the generated steam pressure exceeds a second predetermined value higher than said first predetermined value to thereby relieve excess pressure, one of said inlet casing and said outlet casing having a passage formed therein so that fluid flows out of said third passage means into a space exterior of the body assembly to thereby relieve excess pressure.

3. The valve assembly of claim 2, wherein said first valve means further comprises:

a seal pipe surrounding said first biassing means and having an exterior serfurace spaced from an interior surface of said outlet casing for defining a fluid flow path between the outlet of the second passage means and the portion of the outlet casing connectable to the means for using the generated steam pressure; and means for preventing flow of steam pas said valve member means into the interior of said seal pipe.

4. A pressure regulating and relief valve assembly for regulating pressure and relieving excess pressure, said valve assembly connectable between means for generating fluid under pressure and means for using fluid under pressure, said valve assembly comprising;

inlet means for receiving fluid under pressure;

outlet means for delivering fluid under pressure to a means for using the fluid under pressure;

relief outlet means for delivering fluid under pressure to the exterior of the valve assembly;

first passage means between said inlet means and said outlet means for passing fluid under pressure between said inlet means and said outlet means;

first valve means, positioned within said first passage means, for controlling fluid communication through said first passage means such that fluid flow from said inlet means to said outlet means is established only when the fluid under pressure exceeds a first predetermined value and such that fluid flow from said inlet means to said outlet means is blocked when the fluid under pressure is less than the first predetermined value, said first valve means biassed to normally close the first passage means until fluid under pressure exceeds the first predetermined value;

second passage means between said inlet means and said relief outlet means for passing fluid under pressure between said inlet means and said relief outlet means;

second valve means, positioned within said second passage means, for controlling fluid communication through said second passage means such that fluid communication through said second passage means is established when the fluid under pressure exceeds a second predetermined value, higher than said first predetermined value, and such that fluid communication is not established when the fluid under pressure is less than the second predetermined value.

5. A pressure regulating and relief valve assembly as claimed in claim 4 wherein said first valve means is spring-biassed closed until said fluid under pressure exceeds a first predetermined value.

6. A pressure regulating and relief valve assembly as claimed in claim 5 wherein said second valve means is spring-biassed closed until said fluid under pressure exceeds a second predetermined value.

7. A downhole pressure regulating and relief valve assembly positionable in a well casing, said valve assembly connectable between a steam generator and a probe, said valve assembly comprising:

a valve housing positionable within a well casing and having exterior dimensions so as to define a space between the exterior of the valve housing and the well casing;

inlet means, within the valve housing, for receiving steam under pressure from the steam generator;

outlet means, within the valve housing, for delivering steam under pressure to the probe;

relief outlet means for delivering steam under pressure to the exterior of the valve housing into the space between the exterior of the valve housing and the well casing;

first passage means between said inlet means and said outlet means for passing steam under pressure between said inlet means and said outlet means;

first valve means, positioned within said first passage means, for controlling fluid communication through said first passage means such that fluid flow from said inlet means to said outlet means is established only when the steam under pressure exceeds a first predetermined value and such that fluid flow from said inlet means to said outlet means is blocked when the steam under pressure is less than the first predetermined value, said first valve means biassed to normally close the first passage means until the steam under pressure exceeds the first predetermined value;

second passage means between said inlet means and said relief outlet means for passing steam under pressure between said inlet means and said relief outlet means;

second valve means, positioned within said second passage means, for controlling fluid communication through said second passage means such that fluid communication through said second passage means is established when the steam under pressure exceeds a second predetermined value, higher than said first predetermined value, and such that fluid communication is not established when the fluid under pressure is less than the second predetermined value.

* * * * *